US008220472B2

(12) United States Patent
Kaczmarek

(10) Patent No.: US 8,220,472 B2
(45) Date of Patent: Jul. 17, 2012

(54) DISHWASHER MACHINE COMPRISING A STORAGE CONTAINER

(75) Inventor: Wolfgang Kaczmarek, Schwindegg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 109 days.

(21) Appl. No.: 11/884,561

(22) PCT Filed: Oct. 31, 2005

(86) PCT No.: PCT/EP2005/055670
§ 371 (c)(1),
(2), (4) Date: Aug. 17, 2007

(87) PCT Pub. No.: WO2006/094563
PCT Pub. Date: Sep. 14, 2006

(65) Prior Publication Data

US 2008/0210272 A1 Sep. 4, 2008

(30) Foreign Application Priority Data

Mar. 8, 2005 (DE) ..... 10 2005 010 616

(51) Int. Cl.
*A47L 15/50* (2006.01)

(52) U.S. Cl. ..... 134/133; 134/56 D; 134/57 D; 134/58 D

(58) Field of Classification Search ..... 134/133, 134/48, 56 D, 57 D, 58 D
See application file for complete search history.

(56) References Cited

U.S. PATENT DOCUMENTS

| | | | | |
|---|---|---|---|---|
| 2,131,615 | A * | 9/1938 | Chico et al. | 134/82 |
| 3,466,105 | A | 9/1969 | Guth | |
| 4,021,088 | A | 5/1977 | Murray | |
| 5,409,309 | A | 4/1995 | Giddings et al. | |
| 6,851,775 | B2 * | 2/2005 | Kaiser | 312/404 |

FOREIGN PATENT DOCUMENTS

| | | | |
|---|---|---|---|
| CH | 353498 | * | 4/1961 |
| CN | 86210029 | U | 9/1987 |
| CN | 87102394 | A | 11/1987 |
| DE | 296 15 989 | U | 6/1997 |
| DE | 197 05 821 | | 7/1998 |
| DE | 198 29 650 | | 1/2000 |
| DE | 100 04 454 | | 8/2001 |
| DE | 101 30 609 | | 1/2003 |
| DE | 102 03 957 | | 8/2003 |
| FR | 2 696 088 | | 4/1994 |
| GB | 667595 | | 3/1952 |

OTHER PUBLICATIONS

Machine Translation of Swiss Patent No. CH 353498 to Walter Frech. Apr. 1961.*
International Search Report PCT/EP2005/055670, Jan. 2006.

* cited by examiner

*Primary Examiner* — Michael Barr
*Assistant Examiner* — Benjamin Osterhout
(74) *Attorney, Agent, or Firm* — James E. Howard; Andre Pallapies

(57) ABSTRACT

A dishwasher includes a treatment compartment, a storage container in the treatment compartment, and a drive for moving the storage container out of and/or into the treatment compartment.

25 Claims, 3 Drawing Sheets

DISHWASHER MACHINE COMPRISING A STORAGE CONTAINER

The invention relates to a dishwasher with at least one storage container arranged in a treatment compartment for items to be washed, to which is assigned at least one drive to move said storage container.

BACKGROUND OF THE INVENTION

A dishwasher with a lifting device for a storage container is known from utility model DE 9314357 U1, said lifting device being located in a treatment compartment of the dishwasher. The lifting and lowering of the storage container takes place in a fully automatic manner with the aid of a simple electromechanical system which is operated by an electric motor with polarity reversal.

A serious disadvantage of this solution is that the electric motor generates a torque which only moves the storage container in a vertical direction upwards or downwards, but not in a horizontal direction. In order to load or unload the items to be washed, the user must move the storage container out of or into the treatment compartment manually, because the electric motor only moves the storage container in a vertical direction. To this end, the user must always grasp the treatment compartment while bending down, in order to move the storage container out of or into the treatment compartment.

SUMMARY OF THE INVENTION

The object of the invention is thus to make the method for loading and unloading dishwashers with items to be washed, as cited at the outset, more user-friendly.

The object is achieved in accordance with the invention in that the drive is embodied such that the storage container is moved out of or into the treatment compartment.

This solution is characterized in particular in that the user can move the storage container out of or into the treatment compartment without the exertion of force. Loading and unloading is herewith more user-friendly in that a larger quantity of items to be washed can also be moved out of or into the treatment compartment without effort.

According to a further preferred embodiment of the subject matter of the invention, it is provided that the storage container is moved out of the treatment compartment in a horizontal direction. As a result of this movement it is ensured that the items to be washed do not fall out of the storage container during the movement. The horizontal movement out of the treatment compartment prevents potential energy being consumed to overcome the height difference.

According to a further preferred embodiment of the subject matter of the invention, it is provided that the drive is at least in part arranged outside the treatment compartment.

This arrangement offers the advantage of very low assembly effort, thus making the length of cycle on the production line shorter. Further, arranging the drive outside the treatment compartment prevents fluid from penetrating the area of the drive susceptible to moisture. The possibility of the drive being destroyed by moisture is thus excluded.

According to an alternative embodiment of the subject matter of the invention, it is provided that the drive is arranged at least partially behind a side wall outside the treatment compartment. This arrangement offers the advantage that the drive is arranged in the vicinity of the storage container arranged in the treatment compartment. The drive is thus more readily accessible to the engineer in the case of repair work.

According to a further alternative embodiment of the subject matter of the invention, it is provided that the drive is at least partially arranged in the tub of the dishwasher.

The inventive dishwasher thus has the advantage that the cable leading to a control and regulation device arranged in the tub is short. The shortness of said cable keeps costs low. The tub of the dishwasher provides sufficient space in which to mount the drive.

According to a further preferred embodiment of the subject matter of the invention, it is provided that the drive is embodied as an energy accumulator.

Energy accumulators are in particular characterized in that they can be manufactured at low cost. Furthermore, the power generated by an energy accumulator is sufficient to move the storage container out of and/or into the treatment compartment even in a very full condition.

According to an advantageous embodiment of the subject matter of the invention, it is provided that the movement initiated by the energy accumulator is damped by means of a damping medium, at least in the final phase of the movement.

This arrangement serves to ensure that the storage container is moved into and/or out of the treatment compartment in a controlled, damped manner. The result of this damped movement is to prevent the items to be washed from falling out of the storage container into the treatment compartment or its surroundings, thus excluding the possibility of the items to be washed being destroyed or soiled.

According to an alternative embodiment of the subject matter of the invention, it is provided that the drive is embodied as an electric motor, to which is assigned an actuation means for propelling the storage container.

This solution is particularly characterized in that the electric motor can be manufactured at very low cost. The electric motor converts electrical energy into mechanical work, so that the storage container is automatically moved by the propelling actuation means.

According to an advantageous embodiment of the subject matter of the invention, it is provided that the actuation means is embodied as a toothed gear, which engages with a gear rack arranged on the storage container.

This solution is characterized in particular in that the toothed gear and the gear rack can be manufactured at low cost.

According to a further advantageous embodiment of the subject matter of the invention, it is provided that a means capable of disengaging the toothed gear and the gear rack is assigned to the storage container or the electric motor.

This solution is characterized particularly in that the user has the option of moving the storage container manually or automatically. The user can further remove the storage container from the dishwasher, in order to place it in the vicinity of a drawer and/or cabinet intended for stowage of the items to be washed.

Construction is particularly simple if, according to a preferred embodiment of the subject matter of the invention, it is provided that the means is embodied as an extending facility capable of moving the toothed gear on a drive shaft of the electric motor.

According to a further alternative embodiment of the subject matter of the invention it is provided that the drive is embodied as a cable drive coupled with the electric motor, which drives the storage container.

This solution is particularly characterized in that the cable drive can be manufactured at very low cost. Further, the frictional forces arising in the case of a cable drive are very low, so that the electric motor need generate less electrical energy. This reduces the energy requirements of the dishwasher.

According to a further preferred embodiment of the present invention, it is provided that the drive can be activated by a switching element arranged on the dishwasher.

A dishwasher embodied according to these features is characterized in that the user can automatically move the storage container out of or into the treatment compartment by means of the switching element. The switching element enables user friendly movement of the storage container.

BRIEF DESCRIPTION OF THE DRAWINGS

The invention is explained in a following description, on the basis of an exemplary embodiment shown in simplified form in the drawing, where.

DETAILED DESCRIPTION OF THE EXEMPLARY EMBODIMENTS OF THE PRESENT INVENTION

Figure 1:
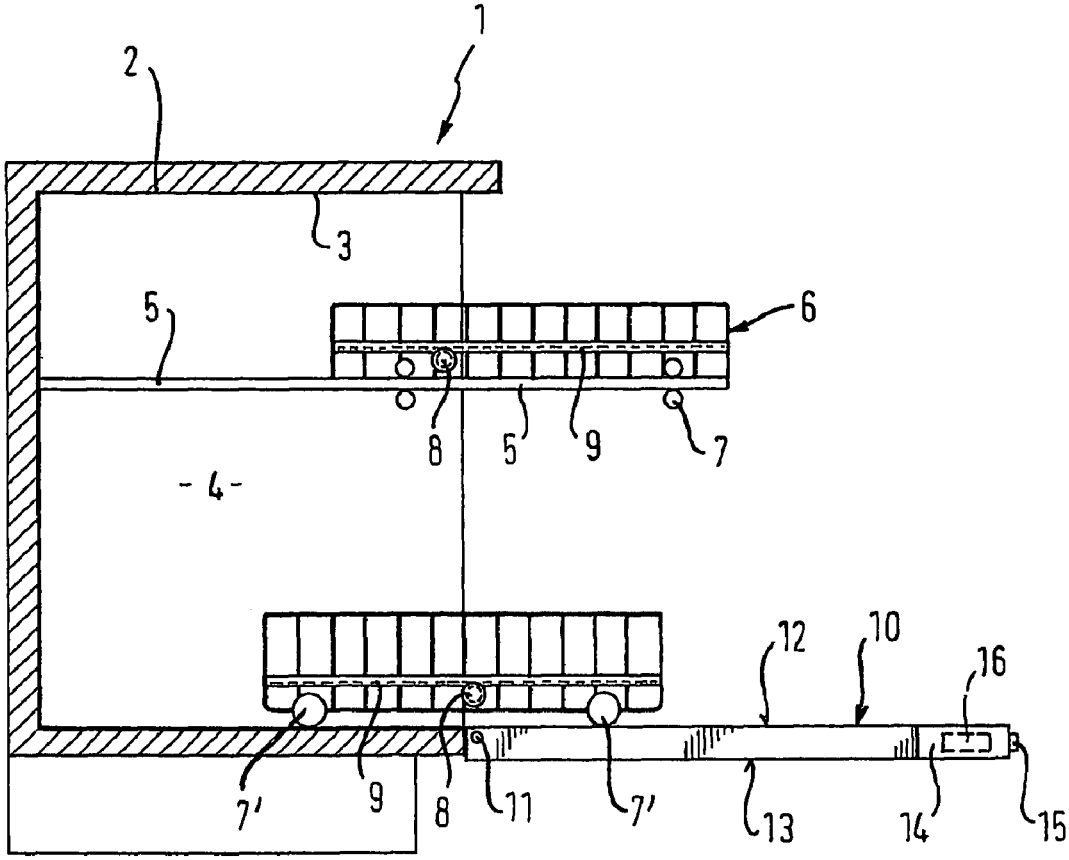
FIG. 1 shows a dishwasher represented from the side in a cross-sectional diagram with a rinsing container, in the treatment compartment of which are arranged two storage containers, each assigned to a drive.

FIG. 1 shows an inventive dishwasher 1 with a rinsing container 2, having an inner casing 3 formed from stainless steel or alternatively plastic to clad a treatment compartment 4. The inner casing has on its side walls guide rails 5, which are embodied as telescopic rails. A crockery basket with guide rollers 7 embodied as a first storage container 6 is fixed to the guide rails 5 in an extendible manner. Guide rollers 7' are assigned to a second storage container 6' for movement purposes which serve to support said storage container 6'. The storage container 6 and the storage container 6' are driven by a drive, to which are assigned a toothed gear 8, a gear rack 9 and a propelling actuating means 20, as shown by the dashed lines in FIG. 2. The propelling actuating means 20 can be an electric motor coupled to the toothed gear 8. Alternatively, the drive can be embodied as a cable drive coupled with the electric motor or alternatively as an energy accumulator. The toothed gear 8 engages with a gear rack 9 arranged on the storage container 6, 6'. An extending facility 22 is assigned to the electric motor (propelling actuating means 20), and is capable of disengaging the toothed gear 8 and the gear rack 9. The treatment compartment 4 is accessible via a door 10 which can be swiveled about a horizontal axis 11. The door 10 has an internal surface 12 and an external surface 13. On the external surface 13 of the door 10 is arranged an operating panel 14, on which is arranged a switching element 15 for activation or deactivation of the drive. The switching element 15 is connected to a control and regulation electronics unit 16.

Figure 2:
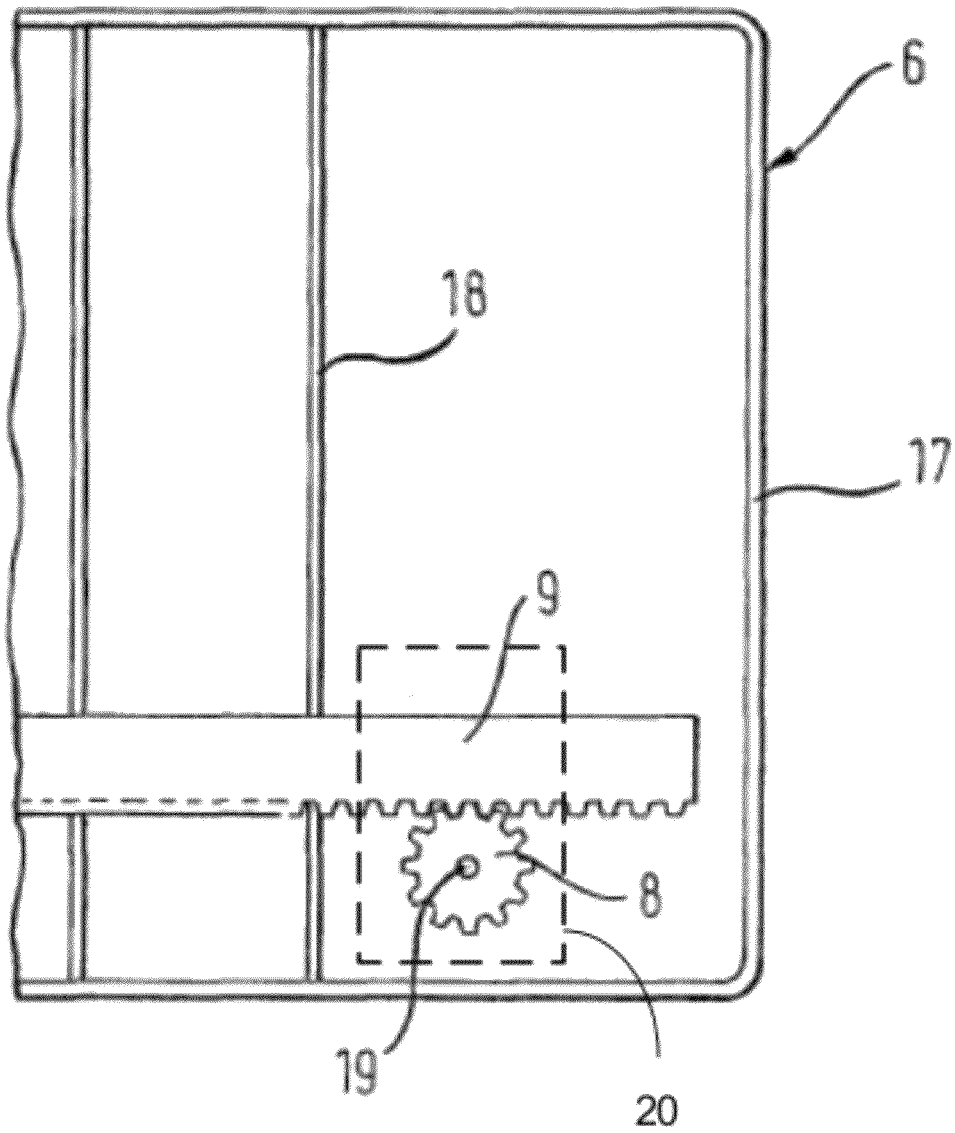
FIG. 2 shows the storage container with the drive, represented in a partial view seen from the side.
Figure 3:
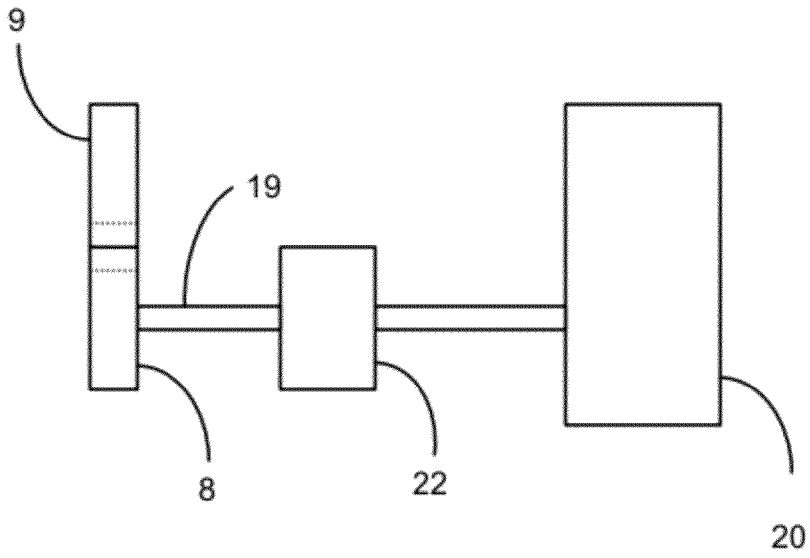

FIG. 2 shows the storage container 6, which has a frame 17, upon which are rods 18, arranged perpendicularly relative to a base surface of the storage container 6, which serve to provide stability of the storage container 6. The gear rack 9 is connected to the vertically arranged rods 18 in a form-fit manner. The toothed gear 8 is connected to a drive shaft 19 in a form-fit manner. The drive shaft 19 is assigned to the electric motor, which is located outside the treatment compartment 4. The electric motor is arranged immediately behind a sidewall, and connected to the control and regulation electronics unit 16. Alternatively, the electric motor can also be arranged in a base. The construction of the storage container 6' is similar to that of the storage container 6.

After operation of the dishwasher 1, the user opens the door 14 by means of the actuating handle, which is not shown, via which the treatment compartment is rendered accessible to the user. In order to move the items to be washed arranged in the storage containers 6, 6' out of the treatment compartment, the user actuates the switching element 15. Through actuation of the switching element 15, a signal is transmitted to the control and regulation electronics unit 16 by means of an electromechanical connection, which activates the electric motor. Through the activation of the electric motor, the drive shaft assigned to said electric motor performs a rotational movement, so that the toothed gear arranged on the drive shaft rotates. As the toothed gear 8 is engaged with the gear rack 9, which is fixed to the drive shaft 19 of the storage container 6, 6', said storage container 6, 6' is moved out of the treatment compartment. A switching element 15 is assigned to each drive, so that the storage container 6, 6' can be moved out of the treatment compartment 4 at different times. If the storage container 6, 6' is moved fully out of the treatment compartment 4, the electric motor is activated by the control and regulation electronics unit, and terminates the movement of the storage container 6, 6'. After the user has removed the items to be washed from the storage container 6, 6', he can refill the latter with items to be washed and move it back into the treatment compartment 4 by means of the switching element 15. If the storage container is once again moved back fully into the treatment compartment 4, the electric motor is once again activated by the control and regulation electronics unit, and terminates the movement of the storage container 6, 6'. The drive is designed in such a way that in the case of items which are difficult to wash, the treatment container 6, 6' can be moved into and out of the treatment compartment. If the user wishes to remove the storage container 6, 6' from the dishwasher 1, the user can dislodge the drive shaft 19 by means of the switching element 15, in order to disengage the toothed gear 8 and the gear rack 9. The storage container 6, 6' is then uncoupled, and moveable by manual means.

The invention claimed is:

1. A domestic dishwasher comprising:

a treatment compartment accessible via a door, wherein the door is pivotable about a horizontal axis to open and close the treatment compartment;

a storage container in the treatment compartment; and a drive for moving the storage container out of and/or into the treatment compartment through the door, wherein the drive includes an electric motor having an actuation device for propelling the storage container, wherein the actuation device includes a toothed gear that engages a gear rack on the storage container.

2. The dishwasher of claim 1, wherein the storage container is horizontally movable out of the treatment compartment.

3. The dishwasher of claim 1, wherein the drive is partially outside the treatment compartment.

4. The dishwasher of claim 1, wherein the drive is partially behind a side wall outside the treatment compartment.

5. The dishwasher of claim 1, wherein the drive is partially in a tub of the dishwasher.

6. The dishwasher of claim 1, wherein the drive comprises an energy accumulator.

7. The dishwasher of claim 6 and further comprising a damper that damps movement initiated through the energy accumulator in a final phase of a movement.

8. The dishwasher of claim 1 and further comprising means for disengaging the toothed gear and the gear rack.

9. The dishwasher of claim 8, wherein the means for disengaging comprises an extending facility, which is capable of displacing the toothed gear on a drive shaft of the electric motor.

10. The dishwasher of claim 1, wherein the toothed gear is located immediately in front of a side wall inside the treatment compartment and the electric motor is located immediately behind the side wall outside the treatment compartment and adjacent to the toothed gear.

11. The dishwasher of claim 1, wherein the electric motor has a drive shaft, and wherein the toothed gear is coupled to the drive shaft and selectively engages and disengages the gear rack of the storage container to selectively automatically propel the storage container horizontally one of out of and into the treatment compartment through the door and facilitate manual movement of the storage container horizontally one of out of and into the treatment compartment through the door.

12. The dishwasher of claim 1, further comprising a switching element for actuating the drive.

13. The dishwasher of claim 1, wherein the electric motor is immediately behind a side wall outside the treatment compartment.

14. The dishwasher of claim 9, wherein the extending facility is immediately behind a side wall outside the treatment compartment.

15. The dishwasher of claim 9, wherein the extending facility moves the toothed gear on a drive shaft of the electric motor.

16. A domestic dishwasher comprising:

a treatment compartment accessible via a door, wherein the door is pivotable about a horizontal axis to open and close the treatment compartment;

a storage container horizontally movable out of and into the treatment compartment through the door; and a drive for moving the storage container horizontally out of and into the treatment compartment through the door, wherein the drive includes:

an electric motor, and actuation means for propelling the storage container, wherein the actuation means are coupled to the electric motor, wherein the actuation means includes a toothed gear that engages a gear rack on the storage container.

17. The dishwasher of claim 16, wherein the toothed gear is located immediately in front of a side wall inside the treatment compartment and the electric motor is located immediately behind the side wall outside the treatment compartment and adjacent to the toothed gear.

18. The dishwasher of claim 16, wherein the electric motor has a drive shaft, and wherein the toothed gear is coupled to the drive shaft and selectively engages and disengages the gear rack of the storage container to selectively automatically propel the storage container horizontally one of out of and into the treatment compartment through the door and facilitate manual movement of the storage container horizontally one of out of and into the treatment compartment through the door.

19. A domestic dishwasher comprising:

a treatment compartment accessible via a door, wherein the door is pivotable about a horizontal axis to open and close the treatment compartment;

a storage container in the treatment compartment;

a gear rack coupled to the storage container; and a drive for moving the storage container one of out of and into the treatment compartment through the door; and wherein the drive includes:

an electric motor having a drive shaft; and a toothed gear coupled to the drive shaft and selectively engaging the gear rack of the storage container to propel the storage container horizontally one of out of and into the treatment compartment through the door.

20. The dishwasher of claim 19, wherein the electric motor is disposed immediately behind a side wall outside the treatment compartment.

21. The dishwasher of claim 19, comprising:

an extending facility that displaces the toothed gear on the drive shaft of the electric motor to selectively engage the toothed gear with the gear rack of the storage container.

22. The dishwasher of claim 21, wherein the extending facility is immediately behind a side wall outside the treatment compartment.

23. The dishwasher of claim 19, comprising:

a switching element for actuating the drive.

24. The dishwasher of claim 19, wherein the toothed gear is located immediately in front of a side wall inside the treatment compartment and the electric motor is located immediately behind the side wall outside the treatment compartment and adjacent to the toothed gear.

25. The dishwasher of claim 19, wherein the toothed gear is coupled to the drive shaft and selectively engages and disengages the gear rack of the storage container to selectively automatically propel the storage container horizontally one of out of and into the treatment compartment through the door and facilitate manual movement of the storage container horizontally one of out of and into the treatment compartment through the door.

* * * * *